United States Patent [19]

Kemp

[11] 3,951,335

[45] Apr. 20, 1976

[54] OVEN STACK ACTION CONTROL

[75] Inventor: Wayne T. Kemp, Kutztown, Pa.

[73] Assignee: Raytheon Company, Lexington, Mass.

[22] Filed: Dec. 30, 1974

[21] Appl. No.: 537,304

[52] U.S. Cl. ..... 236/15 A; 236/45

[51] Int. Cl.[2] ..... F23N 5/04

[58] Field of Search ..... 236/15 A, 45, 101; 60/529

[56] References Cited

UNITED STATES PATENTS

| | | | |
|---|---|---|---|
| 1,162,297 | 11/1915 | Meacham | 236/15 A |
| 2,385,096 | 9/1945 | McCollum | 236/101 D X |
| 2,494,079 | 1/1950 | Andrews | 236/101 |
| 2,714,993 | 8/1955 | Gardiner | 236/15 A |
| 2,867,208 | 1/1959 | True et al. | 236/15 A X |
| 3,053,963 | 9/1962 | Dills | 236/15 A X |

*Primary Examiner*—William E. Wayner
*Assistant Examiner*—William E. Tapolcai
*Attorney, Agent, or Firm*—Harold A. Murphy; Joseph D. Pannone; John T. Meaney

[57] ABSTRACT

An oven having an air inlet opening in its lower region and an exhaust opening in its upper region, and at least one gas-fueled burner within the oven, one of the openings containing a baffle variably movable into and out of closing relation to the opening in response to heat-sensitive actuating means whereby control of stack action within the oven is achieved so that proper air supply to the burner is permitted while simultaneously obtaining decreased heat loss through stack action.

8 Claims, 5 Drawing Figures

OVEN STACK ACTION CONTROL

BACKGROUND OF THE INVENTION

In the operation of gas-fueled ovens it is necessary that the burner or burners therein be supplied with suitable quantities of air for proper combustion. Therefore, such ovens are provided in their lower regions with one or more inlet openings through which fresh air may be drawn into the oven. Additionally, the upper regions of the oven are provided with at least one exhaust opening for permitting escape of combustion products generated within the oven during its operation.

It has been found that when the exhaust opening is relatively large, stack action to expel flue products is sometimes difficult to achieve, and any burner flame may become extinguished by the flue products. It has also been found that in some cases when stack action is achieved, the excessive stack action will cause such a flow of air as may prevent the air from being properly supplied to a burner, thus extinguishing the burner or at least causing inefficient burner operation.

A further problem with many prior art gas ovens is that considerable oven heat is lost by uncontrolled stack action which rapidly draws the heat out of the oven with consequent need to operate the burner or burners at higher heat levels.

SUMMARY OF THE INVENTION

The above and other disadvantages of and objections to prior art gas ovens are overcome or improved upon by the present invention where the oven is provided with means for automatically adjusting stack action in response to variations in temperatures within the oven.

This is achieved by the provision of a baffle in one of the inlet or outlet openings of the oven, which baffle is movable between open and closed positions with respect to the opening in response to movement of a heat-sensing element such as a bimetal device. The baffle is in open position when the oven is cold so as to permit fresh air to flow to the burners for combustion purposes.

When the burner is functioning to produce heat in the known manner, stack action commences with the rising of the heated air. Normally heated air passes out through the exhaust opening causing cool air to be simultaneously drawn into the oven through the inlet opening. This, of course, tends to somewhat cool the oven as heated air is exhausted. Therefore, in accordance with this invention, the bi-metal element functions in response to heat to start closing of the baffle, thereby decreasing the size of the effective aperture of the opening. Thus, the flow of heated air out of the oven is reduced and more of the heated air is retained within the oven, consequently reducing gas consumption required to maintain oven heat at a preselected level. This also prevents accidental extinguishing of the burner which sometimes results from excessive stack action which prevents the burner from receiving a sufficient supply of air for proper combustion.

In accordance with one additional feature of this invention, the baffle is mechanically linked to a gas valve which is connected into the gas line through which gas is supplied to the burner. Thus, as the temperature rises within the oven, and as the baffle moves toward closed position in response thereto, the valve will be operated by movement of the baffle to reduce the flow of gas to the burner. The opposite is true, of course, when temperatures within the oven are lowered. Thus efficiency is improved and economy is effected by the invention. This also then performs as an extra hi-limit switch if so desired.

BRIEF DESCRIPTION OF THE DRAWINGS

The above and other advantages of the invention will become apparent from the following description taken in connection with the accompanying drawings, wherein.

DESCRIPTION OF THE PREFERRED EMBODIMENT

Figure 1:
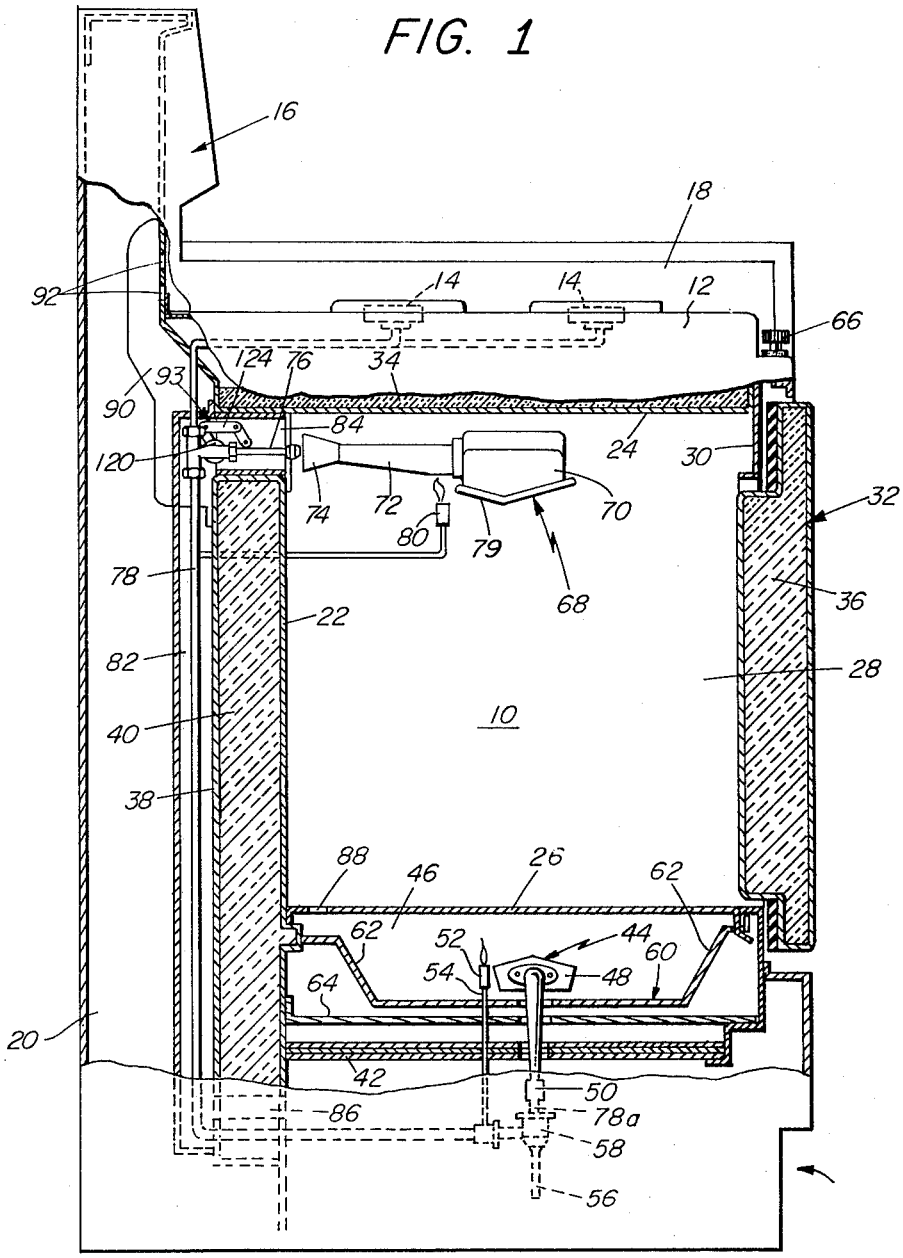
FIG. 1 is a side elevational view of a free-standing gas range showing the oven thereof in vertical section.

Referring more particularly to the drawings wherein like characters of reference designate like parts throughout the several views, the range depicted in FIG. 1 is a type known as a "free-standing" range having an oven 10 and, above the oven, a cooktop 12 with two burners 14 thereof being shown. There is an upstanding backsplash 16 and sidesplashes 18 arranged respectively at the back and sides of the cooktop 12, and a vertical passage 20 extends along the back of the range to provide a passageway for cool air between the oven and an adjacent wall (not shown).

It is to be understood that the invention may be utilized, however, with other types of gas ovens such as a "built-in" wall oven, for example.

The oven 10 is defined by a substantially box-shaped metal liner which delineates the oven cavity and comprises a rear wall 22, a top wall 24, a bottom wall 26, and a pair of side walls 28. An opening is provided in the front of the range and through the liner front wall 30 whereby the interior of the oven cavity is accessible from the front of the range. A door 32 is mounted upon the front of the oven by a suitable hinge structure (not shown) whereby the door is pivotally movable into open or closed relation with respect to the open front of the oven.

The hinge and latching structures are not shown and do not constitute in themselves part of the present invention.

The oven liner top wall 24 is spaced well below the cooking top 12 and heat-insulated therefrom by a bolt 34 of fibrous glass or other selected insulating material which is intended to aid in confining heat as much as possible to the interior of the oven during its operation. The door 32 may be similarly filled with insulating material 36, and at the back of the range an insulating panel or shield 38 is provided in spaced relation with the oven rear wall 22, and the space therebetween is also filled with insulation 40. The sides of the oven are similarly insulated from the outer side wall (not shown) of the range. At the bottom of the range is a heat-reflecting shield or plate 42, provided for reflecting heat upwardly back toward the oven 10 and thus serving to protect the floor beneath the range.

The disclosed oven 10 is provided with two burners tc be described, but in certain cases only a single burner may be employed. A lower burner 44 is located beneath the bottom wall 26 and above shield 42. Burner 44 extends a substantial distance across the cavity 46 in which it resides and is of a conventional blue-flame type which includes a ported burner head 48 having a chamber for receiving gaseous fuel from a venturi 50 or the like. A constantly burning pilot 52 is suitably connected into the gas supply system via pipe 54 and is located adjacent the burner head 48 so that jets of flame will be ignited at each of the ports in the head when the control system (not shown) is operated to allow gas to flow into the head from a supply line 56 via valve 58.

The lower burner 44 is enclosed within the cavity 46 on the bottom and sides by a heat-reflecting shield 60, the bottom of which is mounted above and spaced from shield 42 and which has side portions or wings 62 angled upwardly and outwardly to deflect heat toward the bottom wall 26 of the oven. Suitable apertures are provided in the shields 42 and 60, as well as through an additional intermediate heat reflector 64, for insuring that sufficient air enters the cavity to sustain combustion. Such venting is conveniently done by enlarging the openings in these members through which the pipes to the burner and pilot extend.

The burner head 48 is provided with longitudinally spaced ports so that upon operation a number of jets of blue flame will project outwardly from the respective ports in the normal manner of a burner of this type. The control system may include one of a group of switches controlled by knobs 66 which is suitably connected to the valve means 58 for controlling the flow of gas to the lower ported burner 44 and to an upper radiant burner 68.

The radiant burner 68 is in the oven cavity at the upper extremity thereof and is of a type which produces a broad sheet of flame or incandescence. One example of a radiant burner of a type suitable for use in the self-clean oven of the present invention is that disclosed in U.S. Pat. No. 3,122,197. This burner comprises a device wherein gas is burned on the surface of a screen to heat the screen to incandescence. Such a radiant burner 68 includes a burner head 70 defining an open-sided cavity, and a mixing chamber such as a venturi 72 which has its inner end communicating with the burner cavity and the outer end 74 adapted to receive gas from a pipe 76 which may be connected by valve 58 to a pipe 78 which extends downwardly behind rear shield 38. The mixing chamber 72, for efficient and rapid combustion, is required to receive an ample supply of primary combustion air. For example 10 parts of air to one part of gas is considered to be one satisfactory ratio in the case of natural gas. To insure an adequate supply of uncontaminated primary combustion air, the mixing chamber 72 is made in the nature of an oversized venturi as shown.

The burner 68 also includes as assembly 79 of a number of screens, as described in the aforementioned U.S. Patent, which screens close the open side of the burner cavity, this being the lower surface or side when the burner 68 is positioned in the upper extremity of the oven cavity as shown. It will be apparent that a radiant burner 68 may be made which will produce an extremely broad, substantially continuous flame or incandescence which covers a substantially large radiating area.

The pipe 76 is also connected into the control system so that, when the control system is operated to allow gas to flow from pipe 76 into the mixing chamber 72, where it becomes mixed with air, and then into burner head 70, it will become ignited by the constantly burning flame of a pilot 80. This creates a broad flame which radiates infrared energy throughout the oven cavity. burner. Since It will be noted that primary air is provided for the radiant burner head 70 by means of a duct 82 which extends upwardly along rear wall 38 and terminates at its upper end at an opening 84 at the rear of the oven and into which the end 76 of the mixing chamber extends. Although not shown, the end of the mixing chamber 72 actually is positioned so as to be substantially unaffected by combustion products rising from the lower burner.Since the lower end of the duct 82 terminates in the lower regions of the range, a constant supply of uncontaminated air is allowed to pass into the burner head 70. The lower end of duct 82 is shown as terminating at an opening 86 which communicates with the region of the range beneath the lower heat shield 42.

It will be understood, as pointed out before, that the burners 44 and 68 may be operated individually and separately from one another for conventional baking and broiling operations. However, both burners are operated simultaneously for performing a self-cleaning operation, although the upper burner must be operated for a short time before the lower burner at the start of a self-cleaning operation, and one or both burners may be intermittently operated or modulated during a self-cleaning cycle in order to maintain a required temperature level.

The gas supply line 56 is adapted to be connected to any suitable source of gaseous fuel at one end, and at its other end is connected directly to feed lines by which fuel is constantly supplied to the respective pilots 52 and 80. Thus the pilots are enabled to keep constantly burning. However, since electric ignition may be provided, if desired, in place of the pilots, the pilots are shown merely to suggest one method by which the burners may be ignited.

In an oven of this character it will be understood that little or no movement of air will occur within the oven when the door 32 is closed and when the oven is cold. However, upon ignition of one or both burners, the air within the oven will become heated and will tend to rise, creating what is known as a stack action. For this purpose, the oven bottom wall 26 is provided with at least one opening 88 (FIG. 1) whereby fresh air may be allowed to flow from the cavity 46 upwardly into the oven 10 as heated air is exhausted. The heated air passes out through the upper opening or exhaust vent 84, from which it flows into a vertical flue 90 behind the cooking top and thence upwardly into the backsplash 16, eventually being exhausted into the ambient atmosphere through openings 92 in the front of the backsplash.

It has been found that at times such stack action increases with rising temperatures to the point that not only does waste of heated air occur but extinguishing of burner flame may occur due to lack of sufficient fresh air for combustion. Consequently inefficient operation of the burners occurs, together with loss of efficiency caused by exhaust of heated air. Therefore, means is provided for controlling stack action so as to retain within the oven major amounts of heated air while allowing stack action to occur only sufficiently to maintain ample fresh air for combustion.

Figure 3:
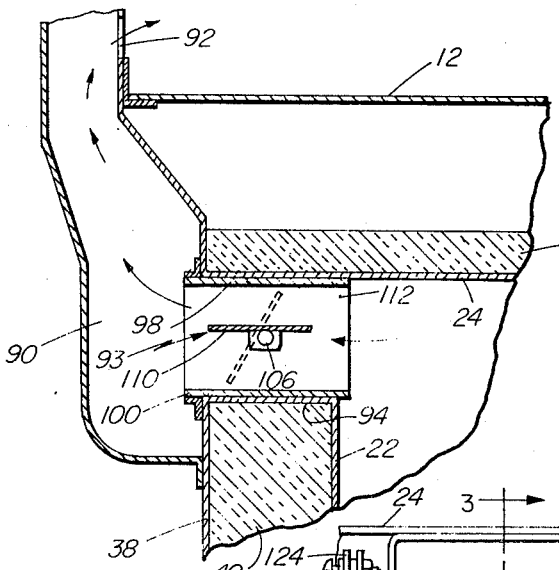
FIG. 3 is a sectional view taken substantially on line 3—3 of FIG. 2 looking in the direction of the arrows and also including a portion of the flue.
Figure 2:
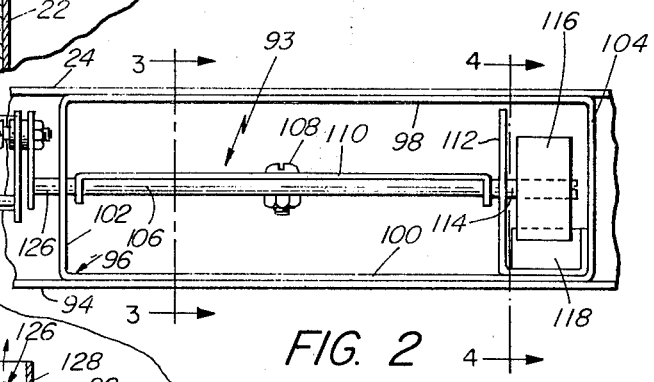
FIG. 2 is an elevational view of the oven exhaust opening area looking rearwardly from within the oven.
Figure 4:
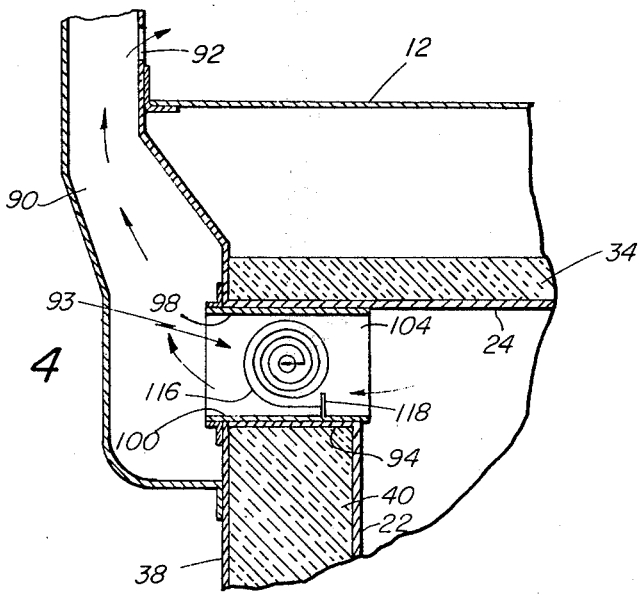
FIG. 4 is a sectional view taken substantially on line 4—4 of FIG. 2 looking in the direction of the arrows and showing a portion of the flue.

In accordance with this invention this is achieved by providing one of the openings with a movable baffle device 93 which operates to reduce the size of the opening with increases in oven temperature. FIGS. 2, 3 and 4 illustrate such a device as applied to the exhaust opening 84.

In FIG. 2 the exhaust opening 84 is located between the oven top wall 24 and a transverse member 94 in the wall at the rear of the oven 10. Although the baffle device 93 of the invention may be supported in many ways, it is shown conveniently as comprising an open-ended boxlike support 96 having a top wall 98, a bottom wall 100, and end walls 102–104.

Extending transversely substantially midway of the support 96 is a rotatable shaft 106 which has fixed to it, as by bolts 108, a transversely extending baffle plate 110. Plate 110 has one end portion rotatably supported in end wall 102 and has its opposite end portion rotatably supported in and extending through an upwardly extending bracket 112 which is fixed at its lower end to the bottom wall 100 in spaced relation to the support end wall 104.

Mounted on the end portion 114 of the shaft within the space between bracket 112 and wall 104 is a coiled bi-metal member 116. The inner end of the bi-metal coil 116 is attached to the end portion 114 of the shaft 106 and its outer end is fixed to a rigid member 118. Thus, when the bi-metal member 116 is subjected to heat from within the oven it will expand and in doing so will rotate the shaft 106 and baffle plate 110. The plate 110 will thus tend to reduce the effective size of the opening and consequently will slow stack action. As a result, more heat will be retained within the oven, thus requiring less consumption of fuel, with resultant improvement in conservation of energy.

A thermostat control (not shown) in the oven normally maintains the heat at a preselected level, as is well known in ovens of this character, by controlling the operation of at least one of the burners in accordance with variations or fluctuations in heat levels. This is usually done by turning the burner on and off as required, or by varying the supply of fuel to the burner to increase or decrease the flame. In accordance with one embodiment of this invention, the baffle device 93 is operatively connected to a valve which controls the supply of fuel to the burner. Therefore, as the baffle plate 110 opens and closes in response to the sensing of different temperature levels by the bi-metal member 116, the valve will be correspondingly opened and closed.

This feature is illustrated in FIGS. 1 and 2 wherein there is shown a valve 120 which is located in the supply line 76 which feeds burner 68. The valve 120 is not shown in detail since it is a conventional device which operates upon rotation of an externally controlled rotatable member 122. Valve member 122 is operatively connected by suitable mechanical linkage 124 to the end portion 126 of shaft 106 opposite end portion 114. Thus, when the shaft 106 is rotated the valve 120 will also be operated correspondingly through linkage 124.

Figure 5:
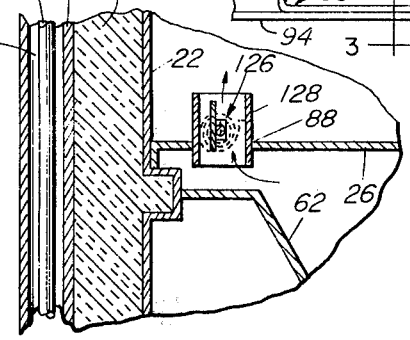
FIG. 5 is a sectional view through a portion of the bottom of the oven showing a baffle device in the inlet opening.

Referring to FIG. 5 a baffle device 126 similar to device 93 is located within a support 128 positioned in the inlet opening 88 of the oven bottom wall 26. This device will function in an identical manner to the baffle device 93 and may, if desired, be connected to a valve (not shown) in the supply line **78*a* which feeds fuel to the burner 44.**

Thus, from the foregoing it will be apparent that a novel and efficient means has been provided for controlling stack action within an oven, whereby increases in both efficiency and economy are achieved.

It will be also apparent, however, that various changes in the structures shown and described may be made by those skilled in the art without departing from the spirit of the invention as expressed in the accompanying claims. Therefore, all matter shown and described is to be interpreted as illustrative and not in a limiting sense.

What is claimed is:

1. An oven having a fresh air inlet opening in its lower region and an exhaust opening in its upper region, and at least one heat-generating burner therein, and baffle means located at one of said openings for controlling stack action comprising a baffle which is normally open with respect to said opening, bi-metal means connected to said baffle for moving said baffle toward closed position with increased temperatures within the oven, said baffle means including a rotatable shaft to which the baffle is fixed, and said bi-metal means being a coil which is attached to said shaft for rotating the shaft and baffle and a pipe connecting said burner to a supply of fuel, and a valve having a rotatable valve stem connected to said pipe for controlling flow of fuel therethrough, said baffle means being operatively connected with said valve stem for operating the valve by rotation of said valve stem simultaneously with movement of the baffle.

2. An oven as set forth in claim 1 wherein mechanical linkage connects said shaft to the valve stem.

3. An oven as set forth in claim 1 wherein said baffle means is located within said exhaust opening.

4. An oven as set forth in claim 1 wherein said baffle means is located within said inlet opening.

5. An oven having a fresh air inlet opening in its lower region and an exhaust opening in its upper region, at least one heat-generating burner within the oven, and baffle means located within one of said openings for controlling stack action comprising a hollow support having spaced end walls, a vertical divider between said end walls forming two compartments in the support, a shaft extending transversely through one compartment and having one end portion projecting through and rotatably mounted in said divider, a bi-metal element in the second compartment having one end fixed to the support and having its opposed end attached to the shaft for rotating same in responseto temperature variations within the oven, and a baffle plate carried by said shaft for rotation therewith.

6. An oven as set forth in claim 5 wherein said bi-metal element is a coil.

7. An oven as set forth in claim 5 wherein a pipe connects said burner to a supply of fuel, and a valve having a rotatable valve stem is connected to said pipe for controlling flow of fuel therethrough, and said baffle means is operatively connected with said valve stem for operating the valve by rotation of said valve stem simultaneously with movement of the baffle.

8. An oven as set forth in claim 7 wherein mechanical linkage connects said shaft to the valve stem.

* * * * *